US006439289B1

(12) United States Patent
Schlotthauer

(10) Patent No.: US 6,439,289 B1
(45) Date of Patent: Aug. 27, 2002

(54) HAND HELD POSTAGE STAMP DISPENSER WITH DISPLAY AND ADVERTISING CAPABILITY

(76) Inventor: Joseph P. Schlotthauer, 3566 Carmel Ter., #3, Cincinnati, OH (US) 45211

( * ) Notice: Subject to any disclaimer, the term of this patent is extended or adjusted under 35 U.S.C. 154(b) by 0 days.

(21) Appl. No.: 09/426,631

(22) Filed: Oct. 26, 1999

Related U.S. Application Data

(60) Provisional application No. 60/105,589, filed on Oct. 26, 1998.

(51) Int. Cl.[7] ..... B65H 5/28

(52) U.S. Cl. ..... 156/539; 156/574; 156/577; 156/DIG. 48; 221/71; 221/73

(58) Field of Search ..... 156/344, 584, 156/574, 577, 579, 540; 221/71, 72, 73, 74

(56) References Cited

U.S. PATENT DOCUMENTS

| | | | | |
|---|---|---|---|---|
| 1,617,791 | A | | 2/1927 | Bolton |
| 2,368,262 | A | | 1/1945 | Oftedahl et al. |
| 2,556,443 | A | | 6/1951 | Renne |
| 2,569,140 | A | * | 9/1951 | Avery ..... 216/50 |
| 2,586,835 | A | | 2/1952 | Leger |
| 3,066,881 | A | | 12/1962 | Krueger |
| 3,222,242 | A | | 12/1965 | Ingalls et al. |
| 3,955,711 | A | | 5/1976 | Schroter et al. |
| 4,436,572 | A | * | 3/1984 | Makley ..... 156/384 |
| 4,570,868 | A | | 2/1986 | Wiggs et al. |
| 4,576,311 | A | | 3/1986 | Horton et al. |
| 4,624,733 | A | | 11/1986 | Hamisch, Jr. |
| 4,685,994 | A | | 8/1987 | Wodnicki |
| 4,954,210 | A | | 9/1990 | Desmond |
| 5,380,395 | A | | 1/1995 | Uchida |
| 5,770,007 | A | | 6/1998 | Czech et al. |
| 5,806,713 | A | | 9/1998 | Dudley et al. |
| 5,806,714 | A | | 9/1998 | Geiger |
| 5,851,348 | A | | 12/1998 | Muenzer et al. |
| 5,863,384 | A | | 1/1999 | Reddy |
| 5,906,701 | A | | 5/1999 | Smythe |
| 5,938,070 | A | | 8/1999 | Welborn et al. |
| 5,996,932 | A | * | 12/1999 | Wang ..... 242/598.5 |
| 6,171,439 | B1 | * | 1/2001 | Groeneweg ..... 156/584 |

* cited by examiner

*Primary Examiner*—Richard Crispino
*Assistant Examiner*—Cheryl N. Hawkins
(74) *Attorney, Agent, or Firm*—Wood, Herron&Evans, L.L.P.

(57) ABSTRACT

A personal postage stamp dispenser is provided for dispensing individual postage stamps of the pressure sensitive adhesively backed type from their release liner backing strips. The dispenser is particularly suited for use as an advertizing or promotional article and is provided in combination therewith. The dispenser can be economically produced so that it can be given away as a promotional item. In its preferred form, the dispenser is hand-sized and supported on wheels or rollers so that it can rest on the top surface of a desk or tabletop. As so mounted, it will be prominently located so that promotional or decorative material on its cover is conspicuously displayed and receives high exposure. The dispenser operates by moving it by hand across the supporting surface of the desk or tabletop. Linkage connected to and driven by the wheels or supporting rollers feed the backing strip around a peeling edge which peels the stamps individually out of the housing of the dispenser into the free hand of the user. The linkage can feed the stamps at any ratio to the distance that the dispenser is moved, and preferably calls for motion that is substantially greater than the dimension of the stamps being dispensed, preferably five to one or ten to one.

3 Claims, 10 Drawing Sheets

HAND HELD POSTAGE STAMP DISPENSER WITH DISPLAY AND ADVERTISING CAPABILITY

This application is based on U.S. provisional patent application Ser. No. 60/105,589 filed Oct. 26, 1998, hereby expressly incorporated by reference herein, to which priority is claimed.

FIELD OF THE INVENTION

This application relates to postage stamp dispensers, particularly to dispensers for dispensing stamps from a roll of backing material, and more particularly to dispensers of the hand held type.

BACKGROUND OF THE INVENTION

Postage stamp dispensers for dispensing postage stamps from a release liner of backing material in roll form are related to pressure sensitive label dispensers but with the stamps having an inherent value that precludes the use of label dispensing devices and techniques with which excessive dispensing or waste can occur. Label dispensers that dispense labels directly onto a substrate are particularly unsuitable for dispensing stamps onto envelopes for individual consumer use in that dispensing errors and stamp loss too often occurs. Furthermore, most label dispensers are suitable for high use applications which makes them too complex and costly for consumer use as stamp dispensers. Stamp dispensers for individual consumer use must be inexpensive to make and simple to use.

The trend of the U.S. Postal Service to provide stamps has resulted in the proposals for small stamp dispensers for dispensing pressure sensitive adhesive coated postage stamps from rolls of backing material. The proposed dispensers of the prior art have several disadvantages, such as requiring long leaders of backing material at the beginning of a roll for the roll to be loaded into the dispensing device. This requires that several stamps, often dollars worth of stamps, be removed from the roll upon loading of the roll into the dispenser. Other devices provide poor control of the length of the stamp roll being fed from the dispenser, making it difficult to control the number of stamps dispensed.

Furthermore, dispensers of the prior art that function to remove an adhesive backed item from a backing layer are not suitable for storage in plane view or where they are conveniently at hand for use when needed.

For these and other reasons there is a need for a postage stamp dispenser that overcomes the disadvantages of the prior art.

SUMMARY OF THE INVENTION

An objective of the present invention is to provide a postage stamp dispenser that is particularly useful for the display of decorative, promotional and advertising material. A particular objective of the present invention is to provide a postage stamp dispenser having a functional core that is particularly adapted to be used with interchangeable outer structure to display different promotional or decorative matter. A further objective of the present invention is to provide a functional postage stamp dispenser that is sufficiently low in cost to produce that it can economically be provided at low or no charge to consumers as an advertising or promotional item.

Another objective of the present invention is to provide a postage stamp dispenser that will dispense pressure sensitive coated postage stamps from a roll of backing material or release liner in a way that provides the user with reliable control over the number of stamps dispensed and avoids waste of stamps, particularly a dispenser that reliably dispenses a single stamp at a time.

In accordance with the principles of the present invention, there is provided a personal postage stamp dispenser with which one can easily remove individual postage stamps of the pressure sensitive adhesively backed type from their release liner backing strips. The dispenser is particularly suited for use as an advertising or promotional article.

The dispenser can be economically produced so that it can be given away as a promotional item. In its preferred form, the dispenser is hand-sized and supported on wheels or rollers so that it can rest on the top surface of a desk or tabletop. As so mounted, it will be prominently located so that promotional or decorative material on its cover is conspicuously displayed and receives high exposure. The dispenser operates by moving it by hand across the supporting surface of the desk or tabletop. Linkage connected to and driven by the wheels or supporting rollers feed the backing strip around a peeling edge which peels the stamps individually out of the housing of the dispenser into the free hand of the user. The linkage can feed the stamps at any ratio to the distance that the dispenser is moved, and preferably calls for motion that is substantially greater than the dimension of the stamps being dispensed, preferably five to one or ten to one.

These and other objectives and advantages of the present invention will be more readily apparent from the following detailed description of the drawings.

DETAILED DESCRIPTION OF THE DRAWINGS

Figure 1:
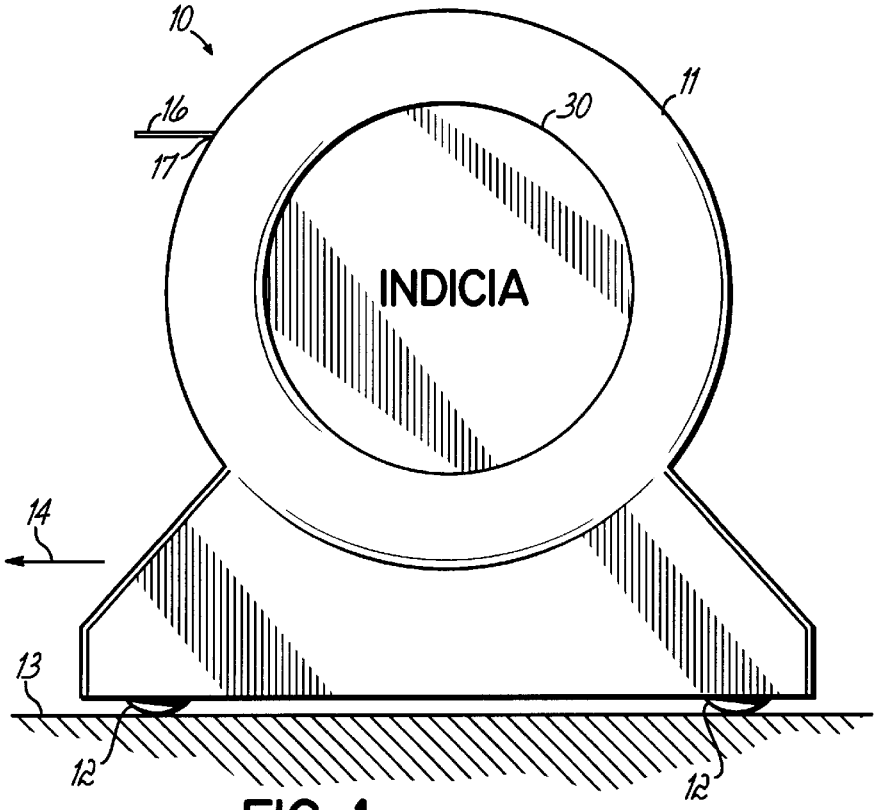
FIG. 1 is a side view of one embodiment of a stamp dispenser according to principles of the invention.

FIG. 1 illustrates a stamp dispenser 10 according to one embodiment of the invention having a plastic housing 11, preferably 3–4 inches long, mounted on wheels 12 so that is rests on a desktop 13. The housing 11 contains a core unit 15 (FIG. 1A) designed so that, as the dispenser is pushed by a hand of a user in the direction of the arrow 14 across the desktop 13, a postage stamp 16 is peeled from its backing strip or web 17 and dispensed into space in front of the dispenser 10 so that it can be removed by the other hand of the user.

Figure 1A:
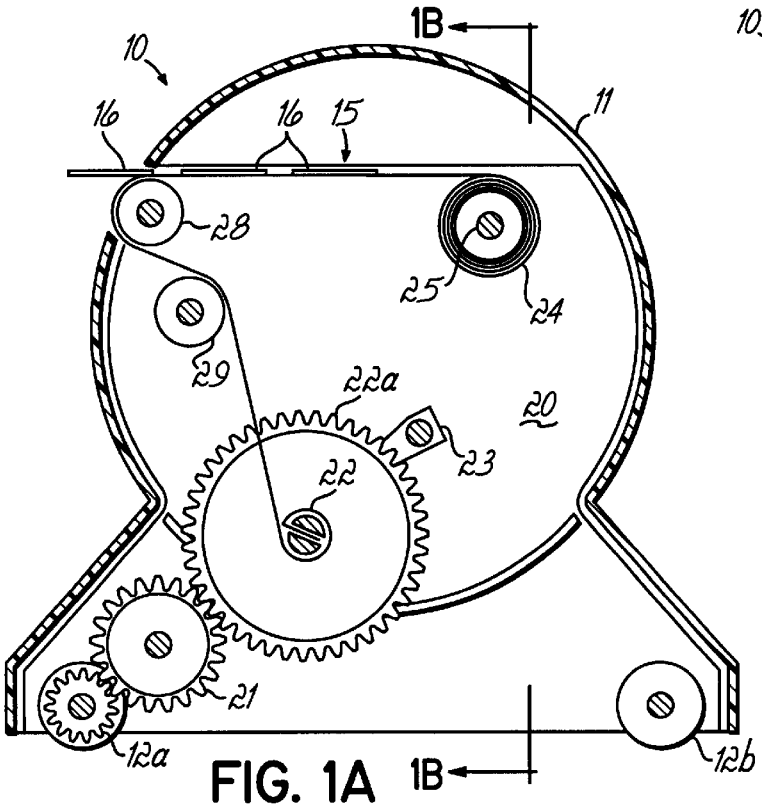
FIG. 1A is a sectional view of the stamp dispenser of FIG. 1.
Figure 1B:
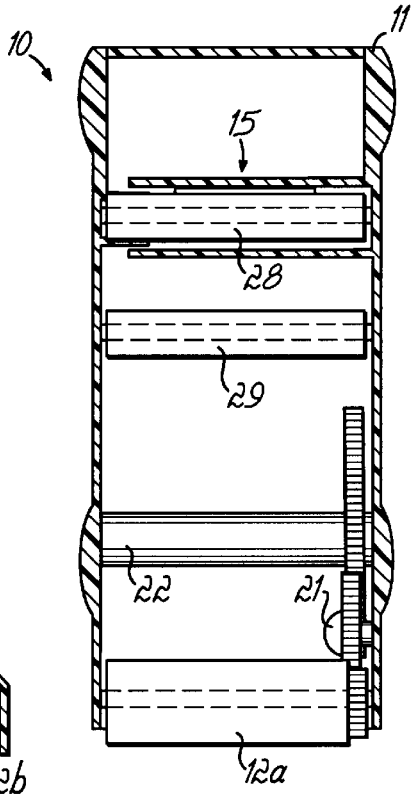
FIG. 1B is a sectional view of along line 1B—1B of FIG. 1A.

As illustrated in FIGS. 1A and 1B, the core unit 15 includes a frame 20, which rotatably supports the wheels 12 on its lower end. One of the wheels 12*a* is a drive wheel while one is an idler wheel 12*b*. The drive wheel 12*a* is positioned to engage and rotate one or more gear wheels or friction wheels 21, rotatably mounted on the frame 20, which in tern engages a gear or friction wheel 22*a* on one end of a take-up real 22, also rotatably mounted on the frame 20, which winds up the spent strip of backing material 17 after stamps 16 have been peeled from it. The take-up reel 22 is preferably provided with a ratchet mechanism 23 to prevent it from rotating backward and unwinding the spent strip 17.

A supply roll or post 25 is provided on the frame 20 around which is supported a supply roll 24 of the stamps 16. A stripping roller 28 is provided on the frame 20 adjacent an opening 29 at the front of the housing 11 around which roller 28 is fed the web 17 bearing the stamps 16. The roller 28 has a sufficiently small diameter as to cause the stamps to separate from the backing material 17 as the stamp bearing web 17 from the supply roll 24 bends around the radius of the roller 28. A guide roller 29 is also provided around which the spent web 17 is fed.

The housing 11 is removable and preferably interchangeable so that a common core structure 15 can be used with several different designs of housing 11, thereby allowing high quantity production of the core to be used with housings 11 of differing designs or with promotional material 30 presented thereon.

Figure 1C:
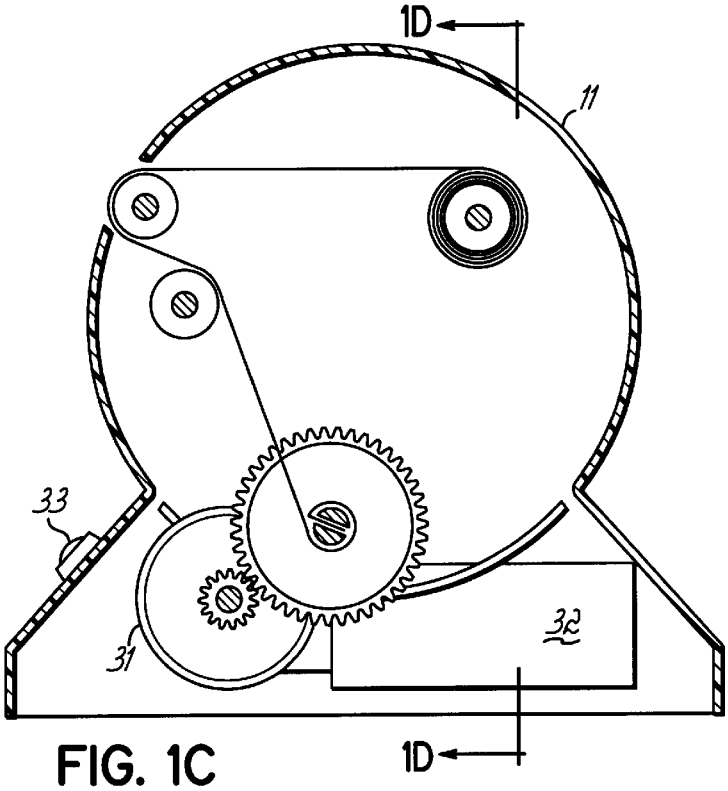
FIG. 1C is a sectional view similar to FIG. 1A of an alternative embodiment the stamp dispenser.
Figure 1D:
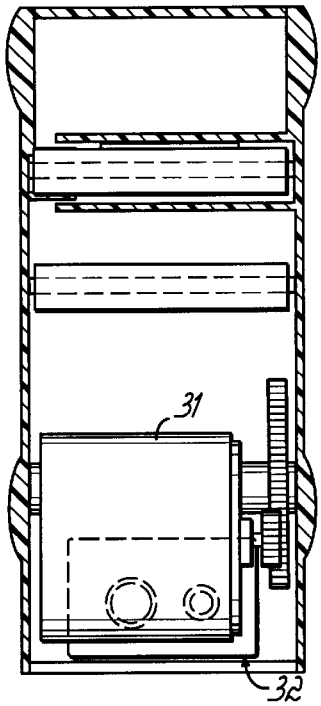
FIG. 1D is a sectional view of along line 1D—1D of FIG. 1C.

Alternatively, as illustrated in FIGS. 1C and 1D, the core 15*a* may be provided which includes a motor 31 and a support for a battery 32 which can be energized by depressing a momentary switch 33 on the housing 11 to drive the take-up roller 22 in lieu of using the wheels 12 to drive the take-up roller 22.

Figure 2A:
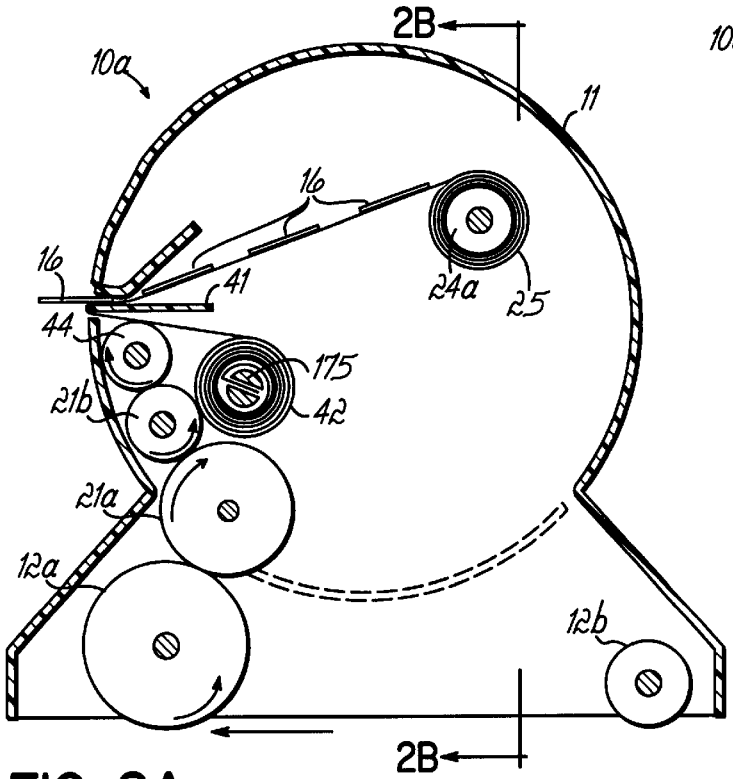
FIG. 2A is a sectional view similar to FIG. 1A of an alternative embodiment the stamp dispenser.
Figure 2B:
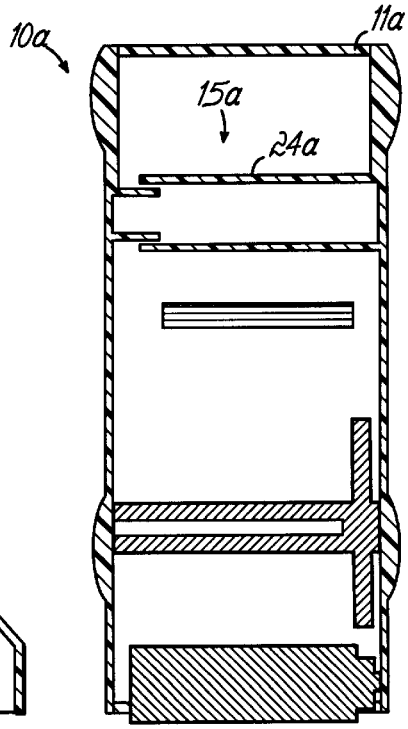
FIG. 2B is a sectional view of along line 2B—2B of FIG. 2A.

As a further alternative, a dispenser 10*a* is provided as illustrated in FIGS. 2A and 2B. With the dispenser 10*a*, a housing 11*a* is provided having a core unit 15*a* integrally formed therewith. The core 11*a* includes a split supply post 24*a* on which a roll of stamps 25 is supported. Instead of a peeling roller 28, a knife blade peeling edge 40 is formed integrally of the core 15*a*, around which a stamp bearing liner 17 is passed to peel the stamps 16 therefrom. A guide 41 is also integrally formed of the core 15*a* of which the knife edge 40 may be part. The guide 41 is curved so as to form a stationary take-up bucket 42 to receive the spend end of the web 17 of backing material. The drive wheel 12*a* drives the one or more friction wheels 21*a*,21*b* to drive a feed roller 44 which advances the web 17 past the knife edge 40.

When the embodiment of FIGS. 2A–2B, the user pushes or otherwise moves the dispenser 10*a* across the surface of the desk 13, the wheel 12 turns and the drive wheel 12*a* turns the feed roller 44. The feed roller 44 is high friction or preferably has an irregular or pinwheel surface that pulls the leading end of the liner and pulls the stamp bearing liner 17 over a peeling edge 40 which separates the adhesively backed stamp 16 from the liner 17 and dispenses the stamp 16 into the free hand of the user. The feed roller 44 can interact with a ratchet pawl (not shown) to prevent it from reversing direction to prevent the liner from losing tension or falling out of the return slot.

The feed roll 44 can be provided with a mechanism (not shown) that allows only one stamp to be dispensed at a time. Such a mechanism can include a stop in the linkage to limit the movement of the dispenser over the surface that will result in the feeding of a stamp 16, so that only one stamp length of the liner strip is advanced. One way to limit the feed is by a limited-rotation of one of the intermediate rollers 21*a*,21*b*, and providing a spring wherein the roller slips without further moving the feed roller 44 or wheels 12. The drive can be engaged and disengaged by the pressure applied to the dispenser 10*a* by the user against the desktop 13 so that when the pressure is released, a spring return on the intermediate roller reverses the intermediate roller 21 and resets the roller 44 to feed another stamp 16.

The stamp roll 25 can be loaded into the dispenser 10*a* by locking the leading end of the strip to the feed roller 44. This can be accomplished by inserting the leading end of the strip 17 bearing the stamps 16 into a slot formed between the feed roller 44 and the bottom of the guide 41 such as by inserting the tip of the strip into the return slot until it is caught by the strip engaging surface of a feed roll which is prevented by a ratchet pawl from reversing rotational direction.

Figure 3:
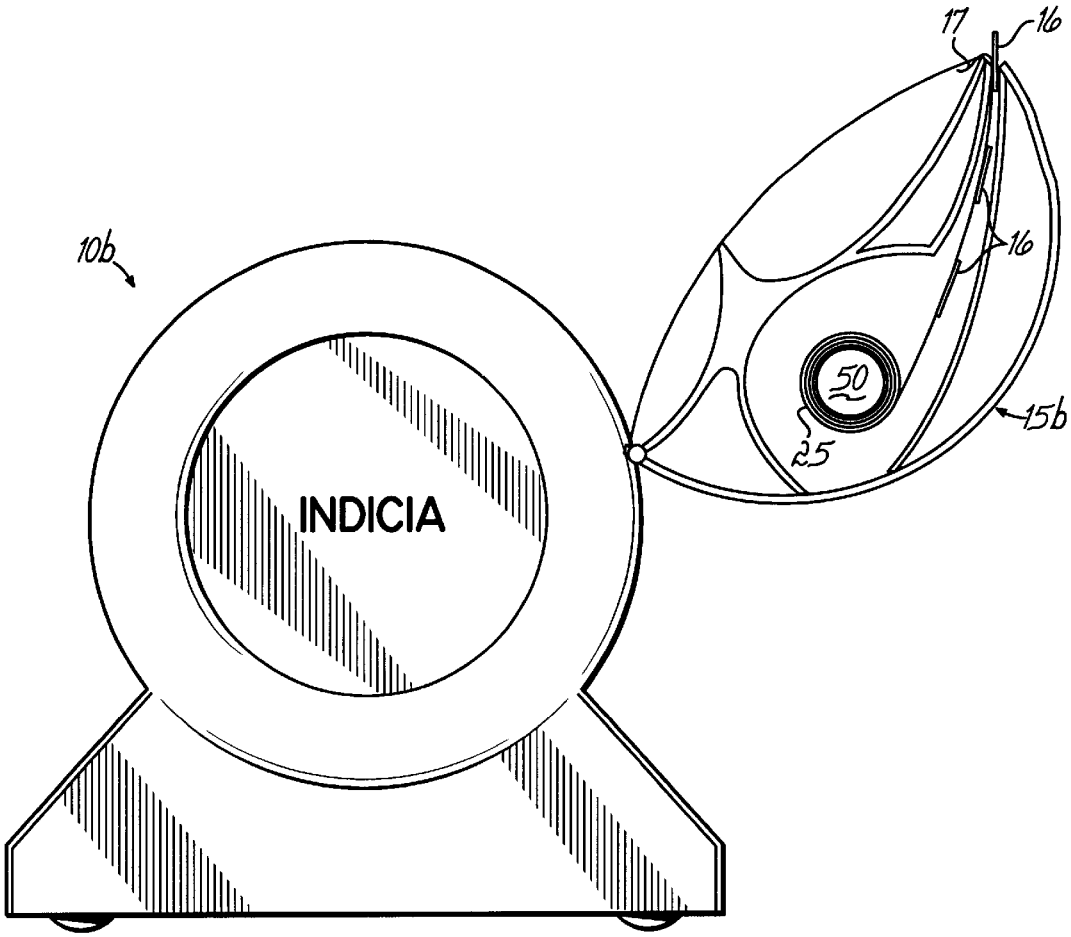
FIG. 3 is a side view similar to FIG. 1 of another alternative embodiment of a stamp dispenser in an open condition.
Figure 3A:
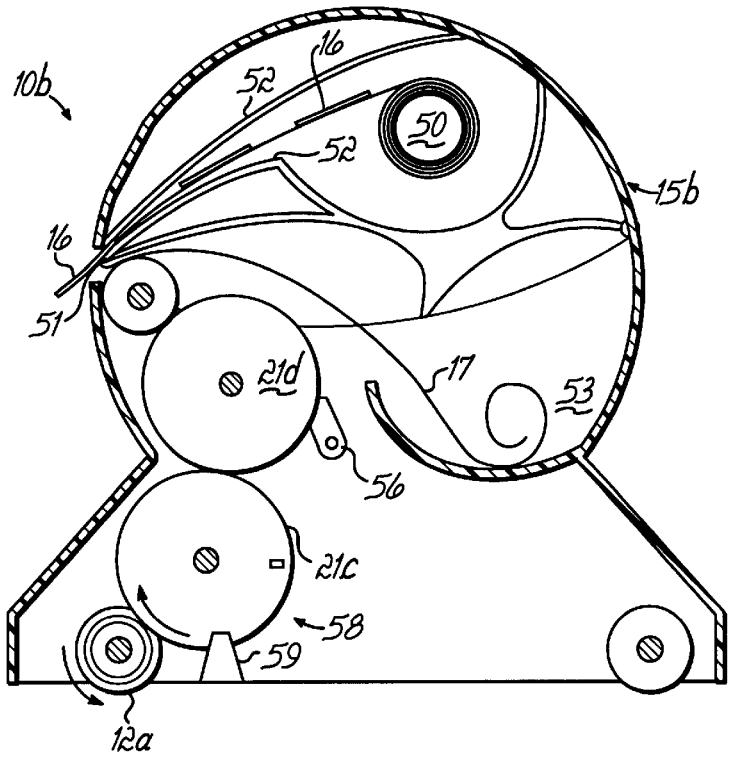
FIG. 3A is a sectional view of the stamp dispenser of FIG. 1 in a closed condition.

FIG. 3 illustrates a further embodiment 10*b* of stamp dispenser in which a core section 15*b* pivots out for the loading of a stamp roll 25 therein. In the core 15*b*, a supply bucket 50 is integrally formed therein to receive the stamp supply roll 25, which simply can be dropped into the bucket 50 in the open core 15*b* after the tip of the strip is engaged by feed roll 44*a* and the core 15*b* closed. The strip from the supply roll passes through a constriction between guides 52 or other structure that applies drag on the strip of stamps and maintains a sharp angle of the stamp bearing strip around the peeling edge 51.

In the embodiment 10*b*, intermediate rollers 21*c* and 21*d* are provided between the feed roller 44*a* and drive wheel 12*a*. Roller 21*d* is provided with a ratchet pawl 56 to prevent the feed roller 44 from reversing direction and the liner from losing tension or falling out of its return path. A bucket 53 is formed integrally of the core 15*b* to collect the spent liner strip 17.

The feed roller 44*a* is provided with a mechanism 58 that allows only one stamp 16 to be dispensed at a time. Such a mechanism 58 can include a stop 59 on an intermediate roller such as roller 21*c* to limit the movement of the dispenser 10*b* over the surface of the desk 13 to allow the feeding of only one stamp 16, so that only one stamp length of the stamp bearing liner strip 17 is advanced.

Figure 4:
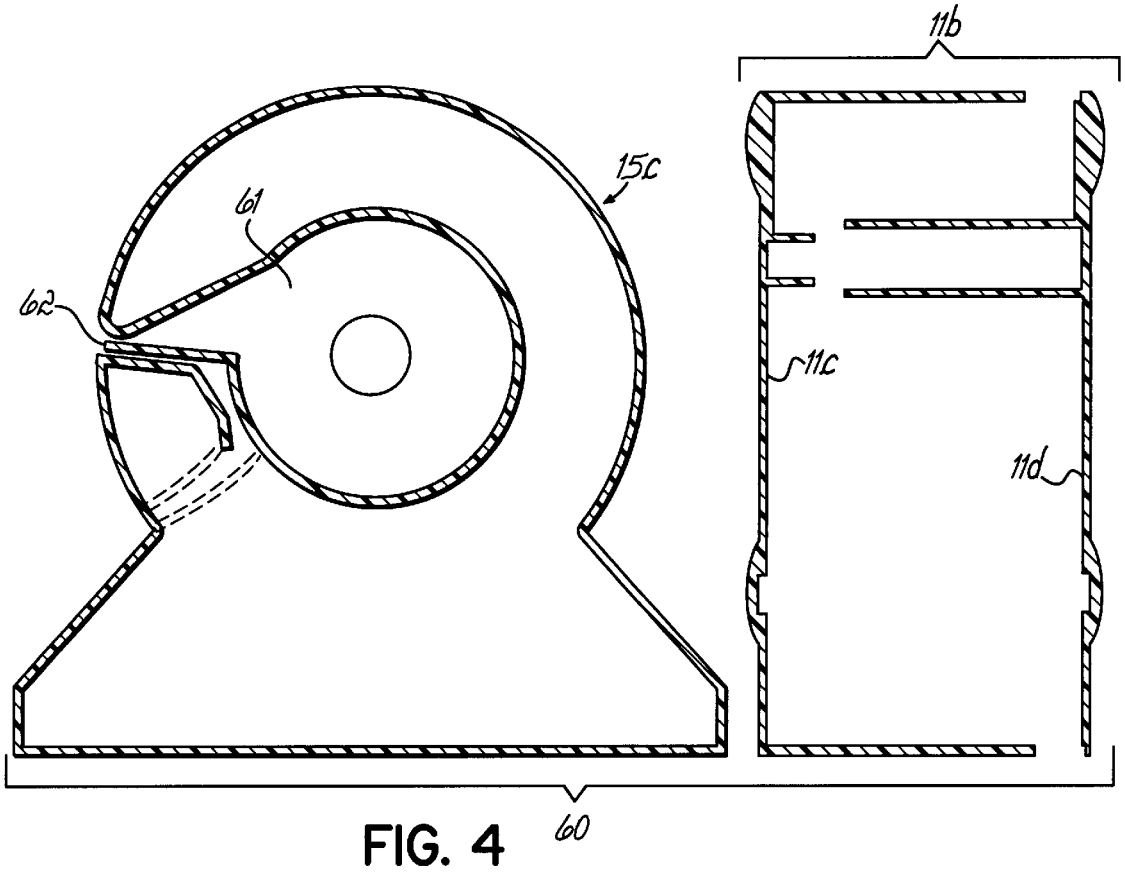
FIG. 4 is an exploded sectional view of still another alternative stamp dispenser.
Figure 5A:
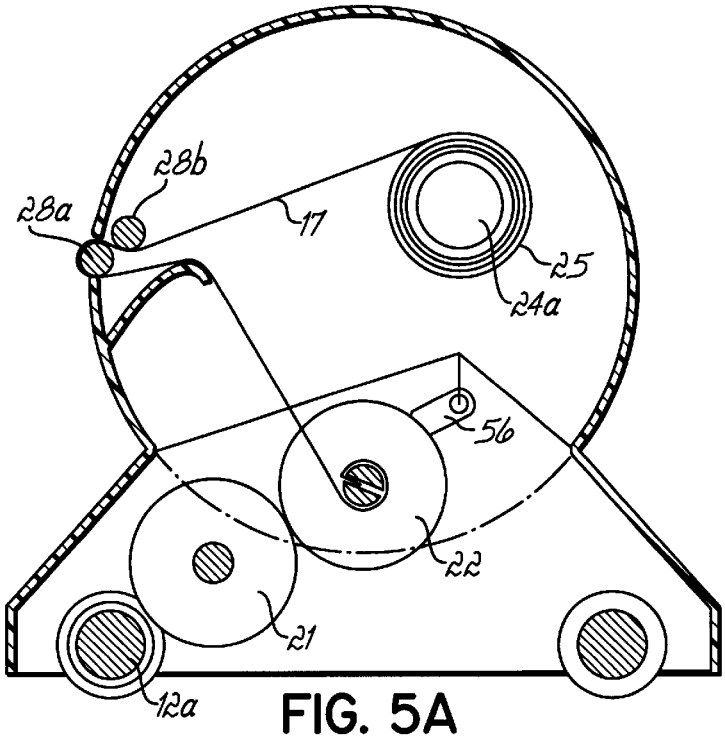
FIGS. 5A–5D are sectional views of additional embodiments of stamp dispensers, particularly the core structure thereof.
Figure 5B:
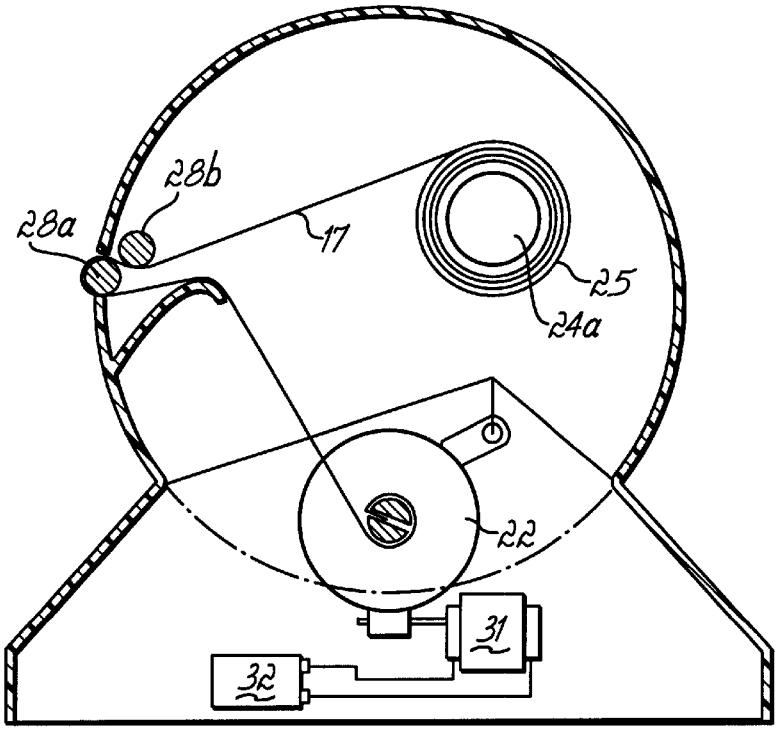
Figure 5C:
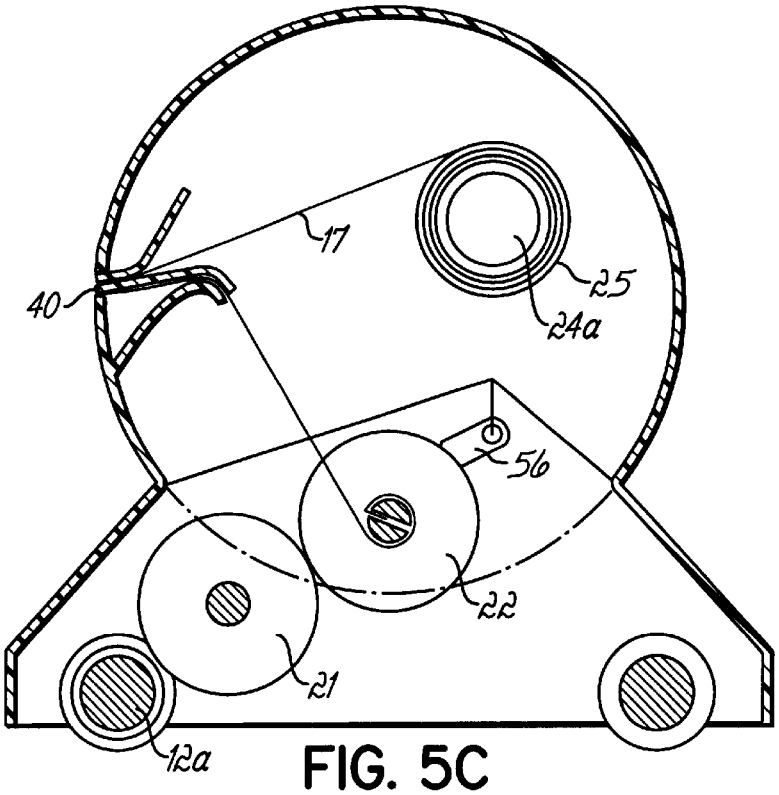
Figure 5D:
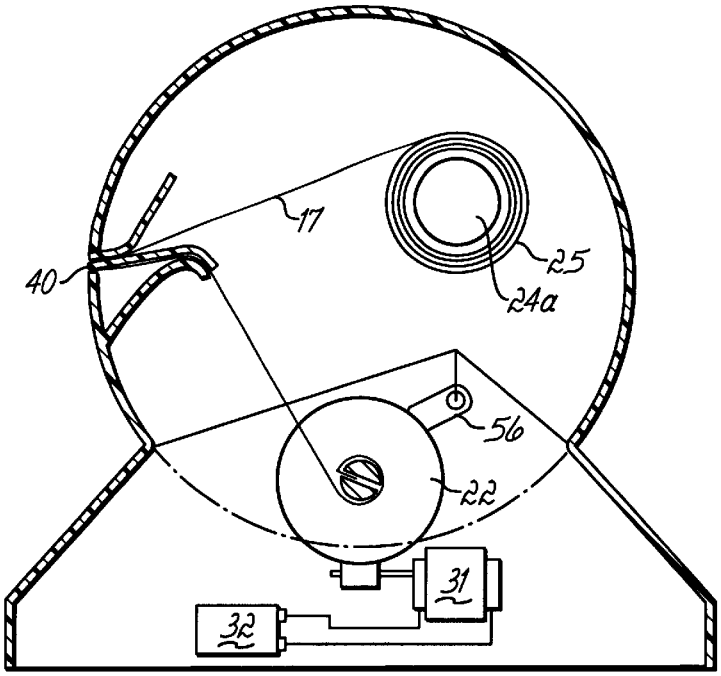

In FIG. 4, a three piece assembly 60 is provided that includes a molded plastic core unit 15*c* in which a well 61 is provided to contain a supply roll 25 of stamps 16, with the well defining structure having formed thereon a peeling edge 62, which functions in the manner described above. A housing 11*b* is formed of two parts, including a front housing 11*c* bearing promotional graphics (not shown) and a rear housing 11*d*, which snap fits into the front housing 11*c* to enclose the core 15*c*.

FIGS. 5A–D show alternative embodiments to the above showing different combinations of the components described. Alternative roller 28*a* serves as the peeling roller, in FIG. 5C, for example, while roller 28*b* serves to increase the drag and peeling pressure on the stamp bearing strip 17.

Figure 6A:
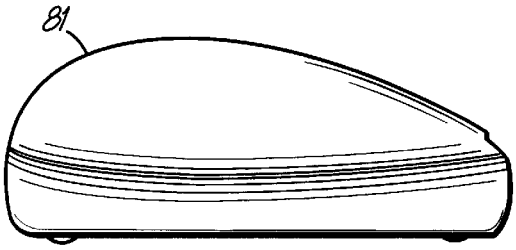
FIGS. 6A—6T are a series of side and sectional views of alternative stamp dispenser embodiments illustrating the versatility of various combinations of promotional and decorative housings in combination core structures that are each suitable for use with more than one different housing.
Figure 6B:
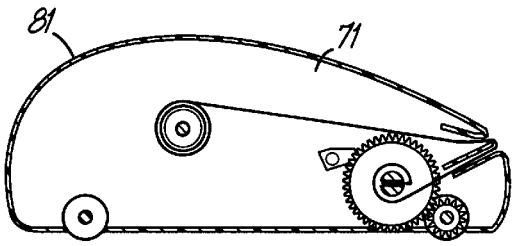
Figure 6C:
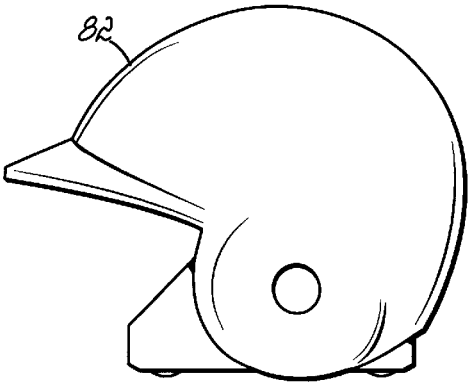
Figure 6D:
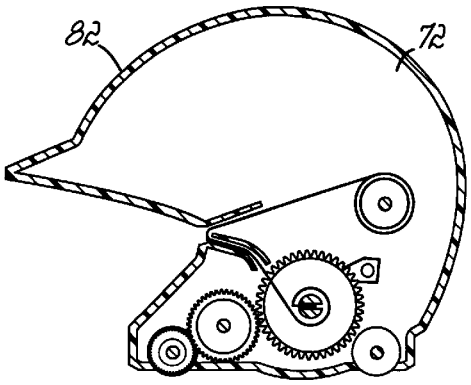
Figure 6E:
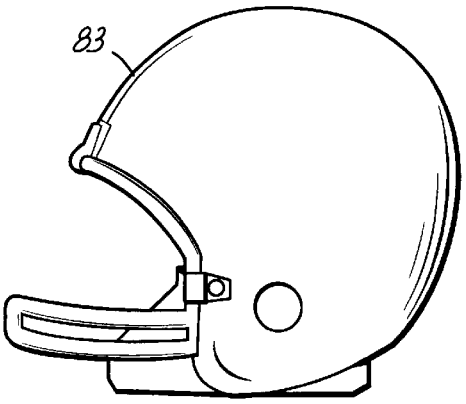
Figure 6F:
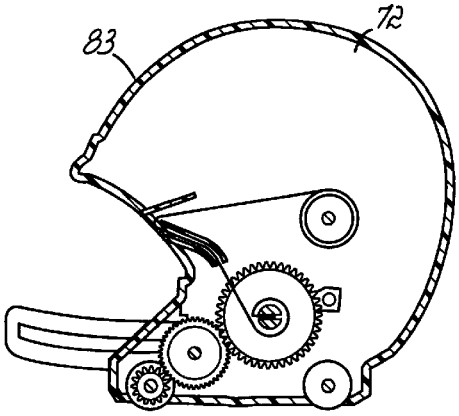
Figure 6G:
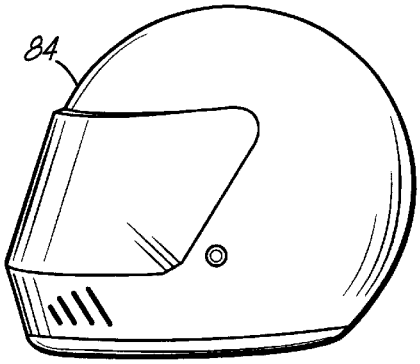
Figure 6H:
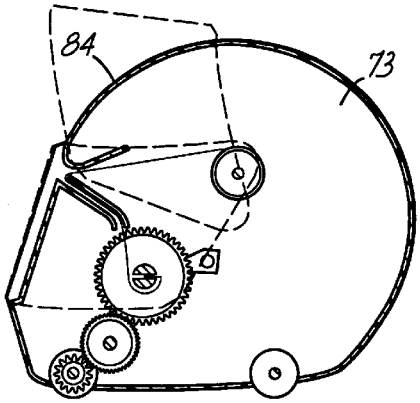
Figure 6I:
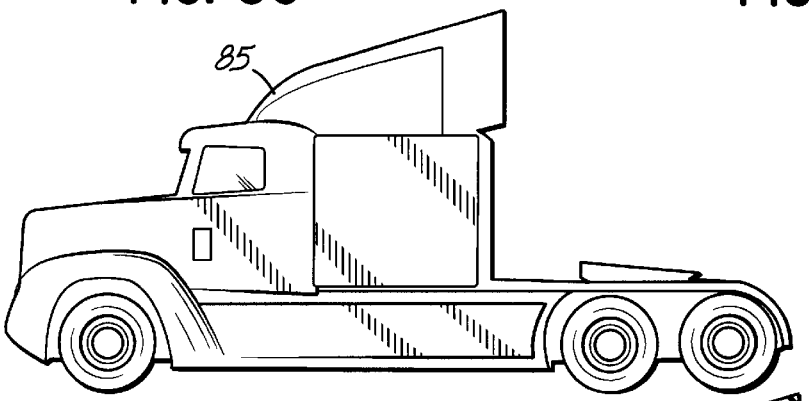
Figure 6J:
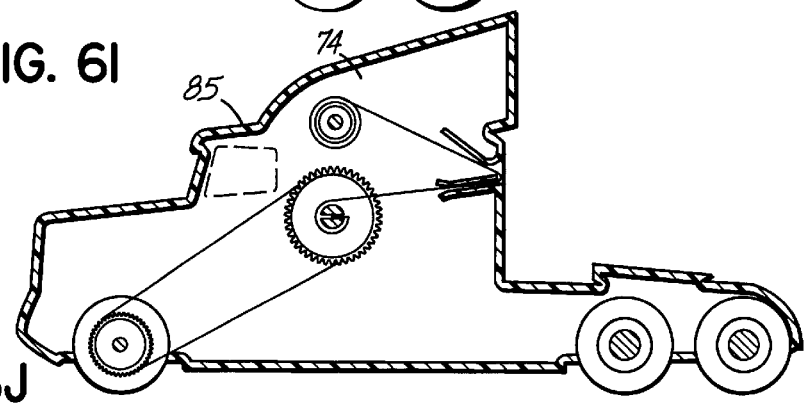
Figure 6K:
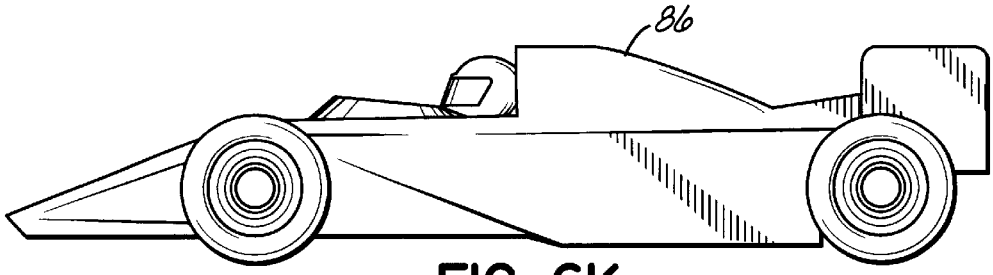
Figure 6L:
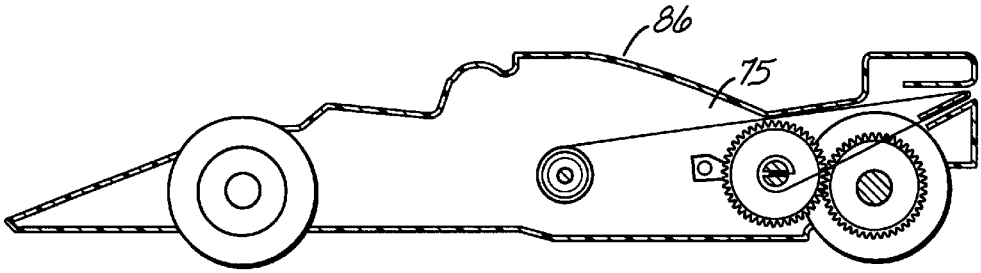
Figure 6M:
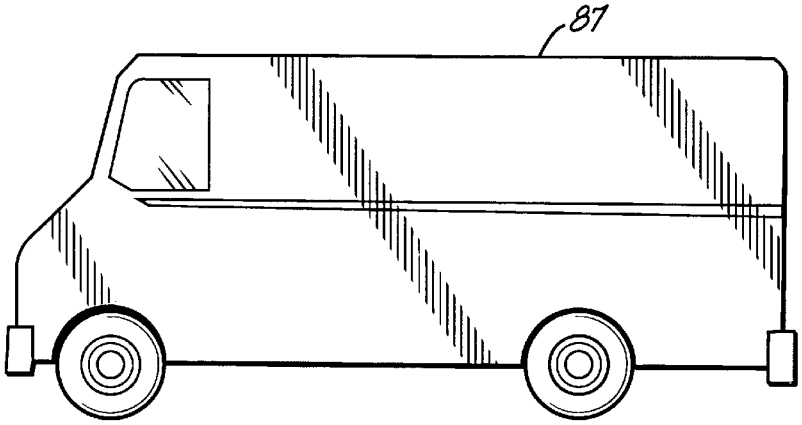
Figure 6N:
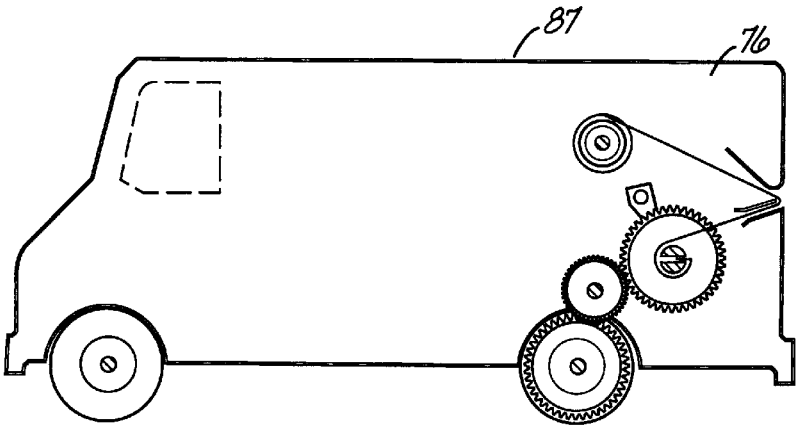
Figure 6P:
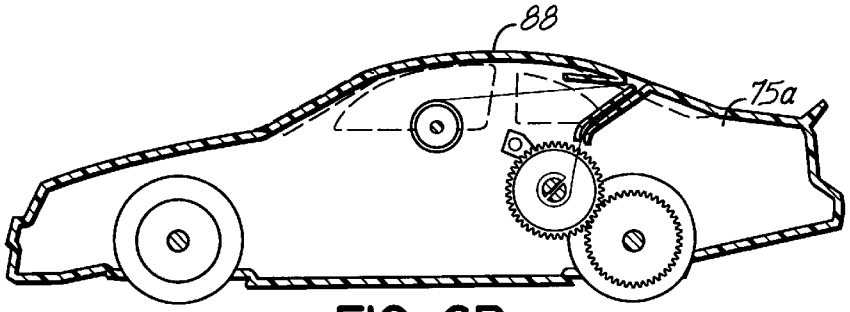
Figure 6O:
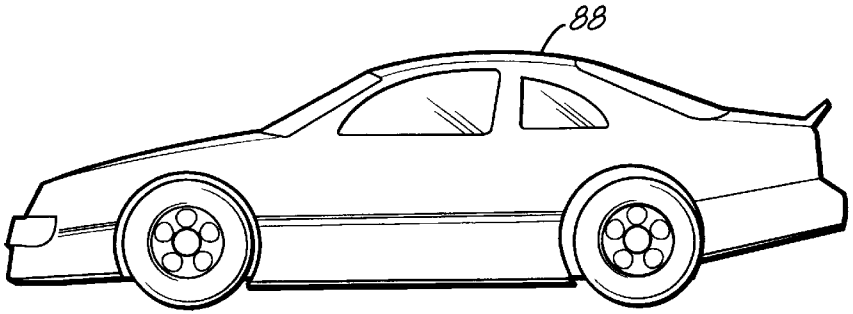
Figure 6Q:
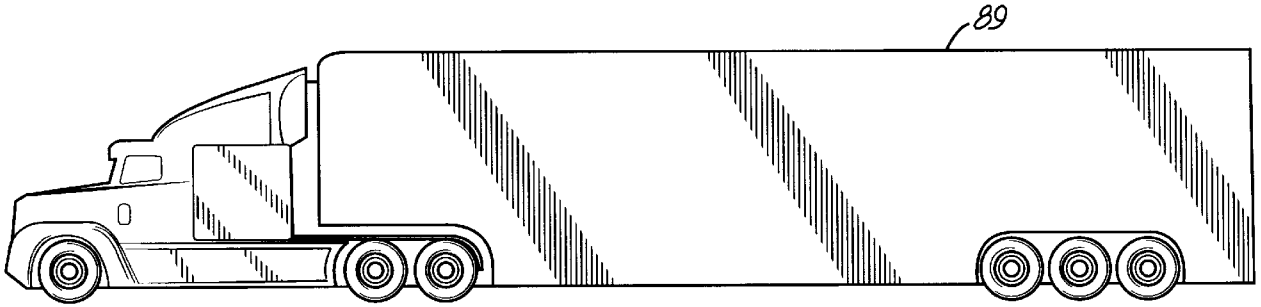
Figure 6R:
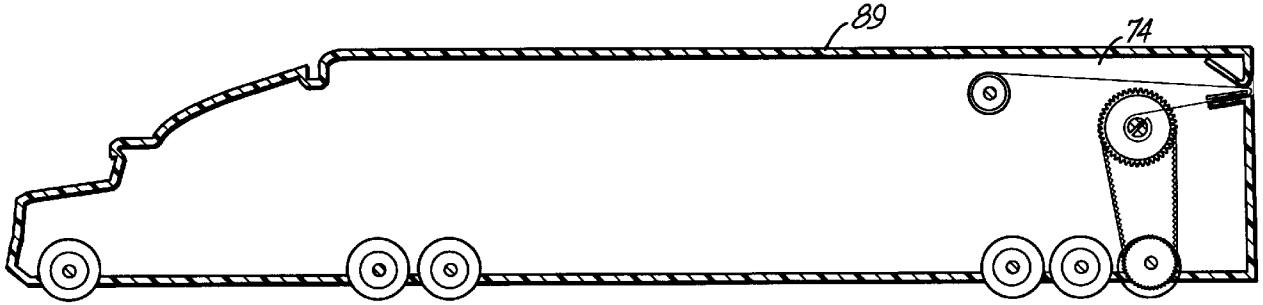
Figure 6S:
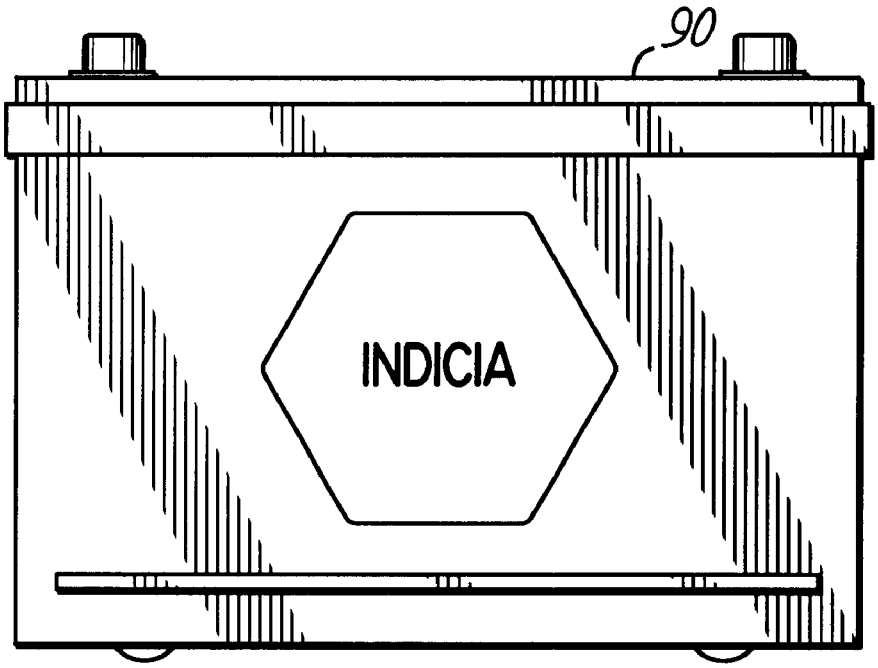
Figure 6T:
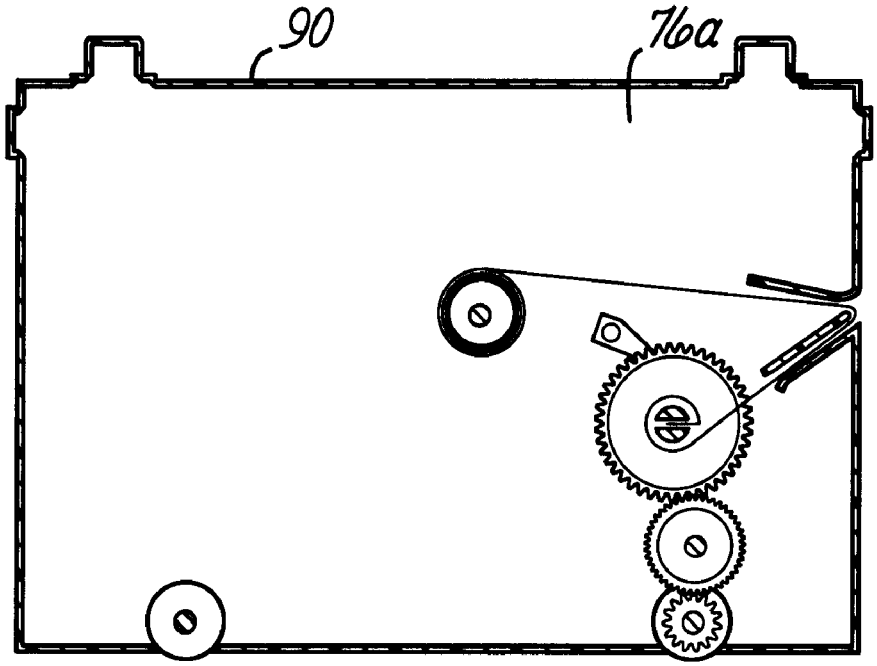

FIGS. 6A–6T illustrate various embodiments of dispensers 70*a*–70*t*, showing various cores 71–76*a* in combination with different housings 81–89. FIGS. 6A–6B illustrate an ergonomic housing design 81 in the shape of a computer mouse, with a simple core structure 71 suitable for use with a variety of housings of different designs. FIGS. 6C–6D illustrate a housing design 82 in the shape of a baseball batting helmet, with a core structure 72. FIGS. 6E–6F illustrate a housing design 83 in the shape of a football helmet, in combination with core structure 72. FIGS. 6G–6H illustrate a housing design 84 in the shape of a racing batting helmet, which may use the core structure 72 or a slightly different core structure 73. FIGS. 6I–6J illustrate a housing design 85 in the shape of a semi tractor, with alternative core structure 74. FIGS. 6K–6L illustrate a housing design 86 in the shape of an Indy racer, with a core structure 75. FIGS. 6M–6N illustrate a housing design 87 in the shape of step van with alternative core structure 76. FIGS. 6O–6P illustrate a housing design 88 in the shape of a NASCAR racer with a core structure 75*a* similar to core structure 75. FIGS. 6Q–6R illustrate a housing design 89 in the shape of a tractor trailer with a core structure 74*a* similar to core structure 74. FIGS. 6S–6T illustrate a housing design 90 in the shape of a car battery with a core structure 76*a* similar to the core structure 76.

While the manually operated dispenser is advantageous for its economy and simplicity, battery operated versions of the dispenser may be desirable, which can use a small motor to advance the feed roll when the user presses a button to operate a switch that connects the battery to the motor to energize the motor. The motor may operate in addition to or instead of the manual movement of the dispenser on its rollers over the supporting surface to advance the feed roll to dispense a stamp. The motor may be selectively connectable to work with or as an alternative to the rollers to drive the feed roll or to be disabled.

What is described above includes the preferred embodiments of the invention. Those skilled in the art will appreciate that additions to and modifications of the system and method of the invention, and the detailed manifestations thereof, may be made without departing from the principles of the inventive concepts set forth herein.

Accordingly, the following is claimed:

1. A dispenser for dispensing pressure sensitive adhesive coated postage stamps from a backing strip release liner from a roll supply, the dispenser comprising:

a housing;

a supply roll support carried by the housing;

at least one wheel or roller configured for moveably supporting the housing on an upwardly facing solid horizontal surface;

peeling means configured to cause a postage stamp to separate from the liner and extend into the space outside of the housing, above and out of contact with the horizontal surface, when the liner bearing the stamp is pulled around the peeling means;

a pulling mechanism positioned on the housing so as to engage a leading portion of liner extending from the supply and pulling the liner across the peeling means;

drive linkage connecting the at least one wheel or roller to the pulling mechanism to drive the pulling mechanism in response to hand initiated movement of the housing over the surface so as to pull the stamp bearing liner across the peeling means to dispense a stamp into free space outside of the housing in a position where the peeled stamp can be manually transferred and applied to an envelope for mailing; and means for limiting the number of stamps dispensed during an operating cycle of the pulling mechanism to one stamp per cycle.

2. A dispenser for dispensing pressure sensitive adhesive coated postage stamps from a backing strip release liner from a roll supply, the dispenser comprising:

a housing;

a supply roll support carried by the housing;

at least one wheel or roller configured for moveably supporting the housing on an upwardly facing solid horizontal surface;

peeling means including a peeling edge or roller configured to cause a postage stamp to separate from the liner and extend into the space outside of the housing, above and out of contact with the horizontal surface, when the liner bearing the stamp is pulled around the peeling means;

a pulling mechanism positioned on the housing so as to engage a leading portion of liner extending from the supply and pulling the liner across the peeling means;

drive linkage connecting the at least one wheel or roller to the pulling mechanism to drive the pulling mechanism in response to hand initiated movement of the housing over the surface so as to pull the stamp bearing liner across the peeling means to dispense a stamp into free space outside of the housing in a position where the peeled stamp can be manually transferred and applied to an envelope for mailing; and a mechanism for limiting the amount of liner fed past the peeling edge or roller during each use of the dispenser to prevent more than one stamp from being dispensed at a time.

3. A dispenser for dispensing pressure sensitive adhesive coated postage stamps from a backing strip release liner from a roll supply, the dispenser comprising:

a housing;

a supply roll support carried by the housing;

at least one wheel or roller configured for moveably supporting the housing on an upwardly facing solid horizontal surface;

peeling means configured to cause a postage stamp to separate from the liner and extend into the space outside of the housing, above and out of contact with the horizontal surface, when the liner bearing the stamp is pulled around the peeling means;

a pulling mechanism positioned on the housing so as to engage a leading portion of liner extending from the supply and pulling the liner across the peeling means; and drive linkage connecting the at least one wheel or roller to the pulling mechanism to drive the pulling mechanism in response to hand initiated movement of the housing over the surface so as to pull the stamp bearing liner across the peeling means to dispense a stamp into free space outside of the housing in a position where the peeled stamp can be manually transferred and applied to an envelope for mailing, the drive linkage being configured to require greater linear travel of the at least one wheel over a supporting surface than the length of stamp bearing liner being pulled by the pulling mechanism.

* * * * *